US012595629B2

(12) United States Patent
McCaughey

(10) Patent No.: US 12,595,629 B2
(45) Date of Patent: Apr. 7, 2026

(54) SUBSTRATE TEXTURING TOOL WITH MOTORIZED LIFT

(71) Applicant: McCAUGHEY ENTERPRISES, INC., Marion, IA (US)

(72) Inventor: Jeff McCaughey, Marion, IA (US)

(73) Assignee: McCaughey Enterprises, Inc., Marion, IA (US)

( * ) Notice: Subject to any disclaimer, the term of this patent is extended or adjusted under 35 U.S.C. 154(b) by 796 days.

(21) Appl. No.: 17/978,569

(22) Filed: Nov. 1, 2022

(65) Prior Publication Data

US 2023/0220634 A1 Jul. 13, 2023

Related U.S. Application Data

(60) Provisional application No. 63/298,021, filed on Jan. 10, 2022.

(51) Int. Cl.
*E01C 19/44* (2006.01)
*E04F 21/24* (2006.01)

(52) U.S. Cl.
CPC ..... *E01C 19/44* (2013.01); *E04F 21/241* (2013.01)

(58) Field of Classification Search
CPC ..... E01C 19/24; E01C 19/44
See application file for complete search history.

(56) References Cited

U.S. PATENT DOCUMENTS 230,081 A * 7/1880 Stubbs ..... E02F 3/6463 37/437
1,424,291 A * 8/1922 Frank ..... A46B 17/08 7/170
2,126,023 A * 8/1938 Mcgoldrick ..... A46B 17/08 294/51
2,300,192 A * 10/1942 Allen ..... E01C 19/264 404/83
3,190,364 A * 6/1965 Maloney ..... A01B 33/06 172/111
3,199,133 A * 8/1965 Ramer ..... B65G 69/2841 14/71.3
3,279,822 A * 10/1966 Orendorff ..... A01B 63/32 172/813
3,406,761 A * 10/1968 Ryan ..... B62D 51/06 15/93.1
4,735,018 A * 4/1988 Duncan ..... E05F 15/53 49/340
4,752,154 A * 6/1988 Valentine ..... E01C 19/44 404/101
5,352,063 A * 10/1994 Allen ..... E01C 19/008 404/84.2
5,727,829 A * 3/1998 Bellichak ..... A01B 1/20 294/51
5,788,592 A * 8/1998 Nycz ..... A01K 5/005 474/38
6,088,865 A * 7/2000 Truan ..... E01H 1/02 15/190

(Continued)

*Primary Examiner* — Christopher J Sebesta
*Assistant Examiner* — Katherine J Chu
(74) *Attorney, Agent, or Firm* — SHUTTLEWORTH & INGERSOLL, PLC; Jason R. Sytsma

(57) ABSTRACT

A smoothing platform; a brush frame; a brush combined to the brush frame; and an actuator attachable to the smoothing platform comprising a rod attachable to the brush frame for moving the brush frame relative to the smoothing platform between a raised position and a lowered position.

10 Claims, 2 Drawing Sheets

(56) References Cited

U.S. PATENT DOCUMENTS

| | | | | |
|---|---|---|---|---|
| 6,679,652 | B2 * | 1/2004 | Suriano | E01C 19/44 404/97 |
| 6,695,532 | B2 * | 2/2004 | Somero | E01C 19/29 404/75 |
| 7,026,558 | B1 * | 4/2006 | Andreyo | H01H 3/58 200/17 R |
| 7,066,276 | B1 * | 6/2006 | Wilcox | G01C 5/00 172/1 |
| 7,357,596 | B2 * | 4/2008 | Face, III | E01C 19/42 404/83 |
| 8,429,785 | B1 * | 4/2013 | Royal | E01C 19/44 15/235.8 |
| 9,091,028 | B1 * | 7/2015 | McCary, Sr. | E04F 21/241 |
| 11,904,645 | B1 * | 2/2024 | Keigley | B60D 1/155 |
| 12,150,396 | B1 * | 11/2024 | Keigley | A01B 59/042 |
| 2007/0056085 | A1 * | 3/2007 | Dyson | A47K 13/10 4/246.1 |

* cited by examiner

SUBSTRATE TEXTURING TOOL WITH MOTORIZED LIFT

PRIORITY CLAIM

This non-provisional application claims the benefit of and priority to U.S. Provisional Patent Application No. 63/298,021 filed on Jan. 10, 2022, the entire contents of which are hereby incorporated by reference herein.

TECHNICAL FIELD

This invention relates to a substrate finishing tool, and more specifically, this invention relates to hand-held finishing tool with motorized lift for freshly placed substrate.

BACKGROUND INFORMATION

Concrete is used for a multitude of different applications including the formation of substantially horizontal, hard surfaces commonly referred to as flatwork. The concrete is initially formed into a pourable and workable substance comprising cement, rock aggregate, water, and other additives. The concrete is then poured into forms or other containing structures where it hardens, or "cures". As the concrete begins to harden, it is generally worked with trowels, troweling machines or various other instruments in order to obtain a relative uniform, non-wavy, durable surface. As a result of such activity, the surface of the concrete may obtain a relatively smooth texture, which can be dangerous for some applications—such as sidewalks, driveways, highways, and the like—particularly when the surface is damp, frosty or icy.

To minimize such dangers, the concrete is given a roughened surface as it is hardening, sometimes referred to as a "broom" finish. Such roughening is sometimes accomplished by pushing or dragging the bristles of a broom across the surface of the hardening concrete in a direction generally perpendicular to the anticipated flow of traffic on that surface. As a result, the surface is scored with randomly spaced bristle marks, which marks harden in the surface of the concrete thereby providing a surface which minimizes tendencies for slipping.

It is well known to use a garage-type push broom or brush to roughen or score the surface of concrete. Such brushes typically have a width of two feet, or less. Some prior art brushes specially manufactured for finishing concrete have widths of 24, 36 or 48 inches. The bristles thereof, which are generally constructed of polypropylene, horsehair, or nylon, are generally staple set or otherwise formed into channel style strips in a wooden head such that the bristles extend generally perpendicularly downwardly from the wooden head.

To maneuver the brush over the surface of the wet concrete, the brush head is generally attached to the end of a long handle having a sufficient number of sections attached end-to-end such that a user can reach either entirely across the flatwork or at least half-way across, depending on the width of the flatwork. The user then places the bristles of the brush against the flatwork at the side of the flatwork nearest the user and uses the handle to push the brush in a straight line to the side of the flatwork opposite from the user (or slightly beyond midway as the case may be).

This process can requires separate tools. A smoothing or texturing tool is used to provide the substrate with a relative uniform, non-wavy, durable surface. A finishing brush is then used to roughen or score the surface of concrete.

Accordingly, there is a need for a single tool that can be used for both smoothing and finishing the substrate.

SUMMARY

Disclosed is a powered texturing tool according to this disclosure. Texturing tool comprises of a smoothing platform; a brush frame; a brush combined to the brush frame; and an actuator attachable to the smoothing platform comprising a rod attachable to the brush frame for moving the brush frame relative to the smoothing platform between a raised position and a lowered position.

In an embodiment, a remote control switch is provided that is communicatively combined to a transmitter in communication with a receiver. The receiver can be combined to the smoothing platform and operatively connected to the actuator for remote operation of the actuator to move the brush frame relative to the smoothing platform between the raised position and the lowered position. A battery can be mounted to the smoothing platform with the receiver combined to and positioned between the battery and operatively coupled to the actuator.

A slack line is combined between the rod of the actuator and the brush frame. The slack line has slack when the brush frame is in the lowered position so that the brush and the brush frame free floats on its own weight. The rod of the actuator is oriented perpendicular to a smoothing face of the smoothing platform with the slack line positioned between the rod and a first lifting frame attached to the texturing brush.

The first lifting frame can comprise a first bracket combined to the smoothing platform; a first pivot attached to the first bracket; an elongated member combined to the first bracket by the first pivot; a second bracket combined to the brush frame; and a second pivot attached to the second bracket and the other end of the elongated frame. This configuration allows the texturing brush to pivot upward and downward in the raised and lowered positions. In an embodiment, a second lifting frame and a third lifting frame positioned on opposite sides of the first lifting frame to support the weight of the texturing brush.

In an embodiment, a coupler is combined to the smoothing platform. The coupler has a horizontal pivot. The handle is combined to the smoothing platform by the horizontal pivot so that the smoothing platform can be manually manipulated by an operator.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
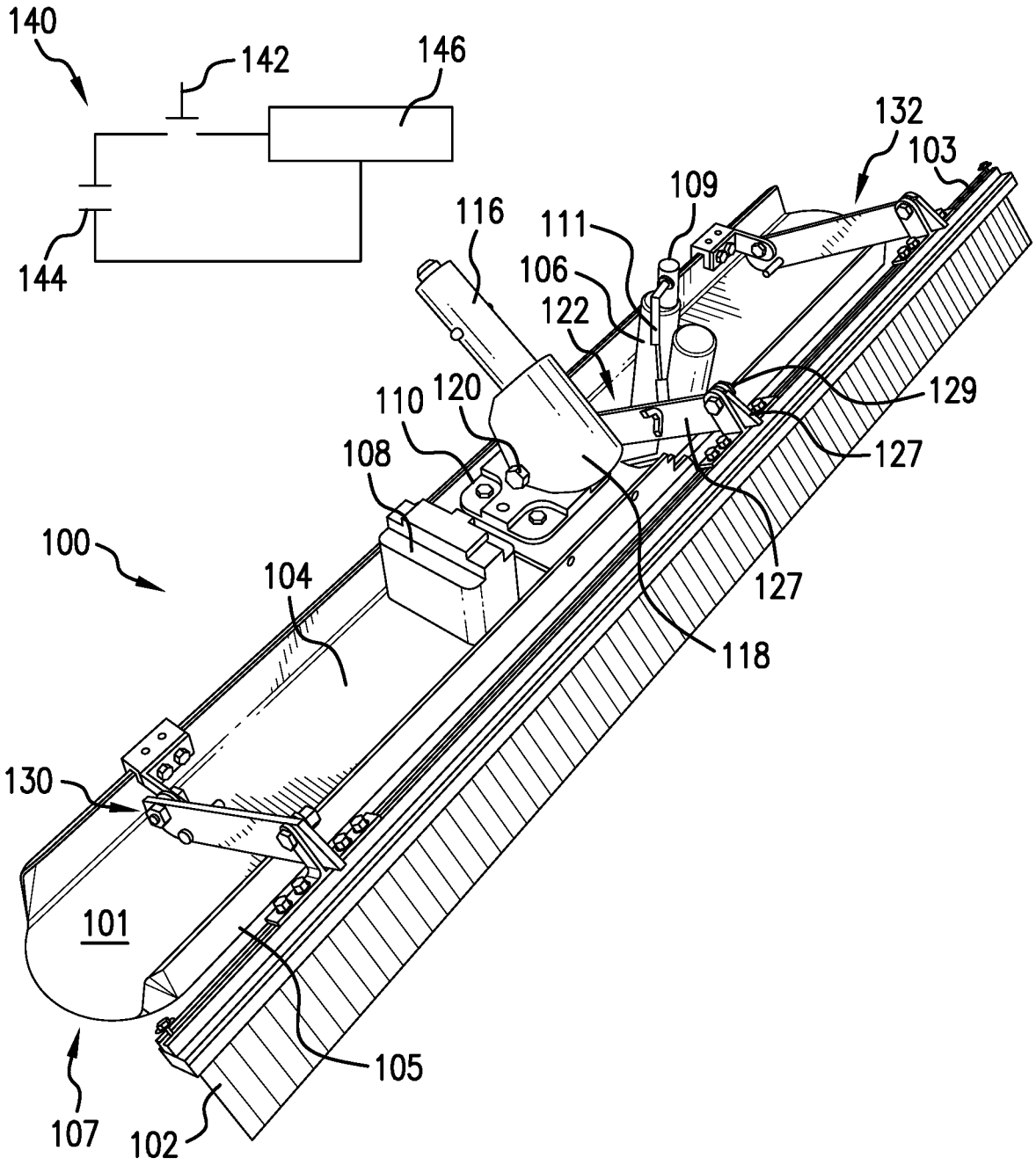
FIG. 1 is a perspective view of a substrate finishing tool with a motorized lift according to this disclosure.
Figure 2:
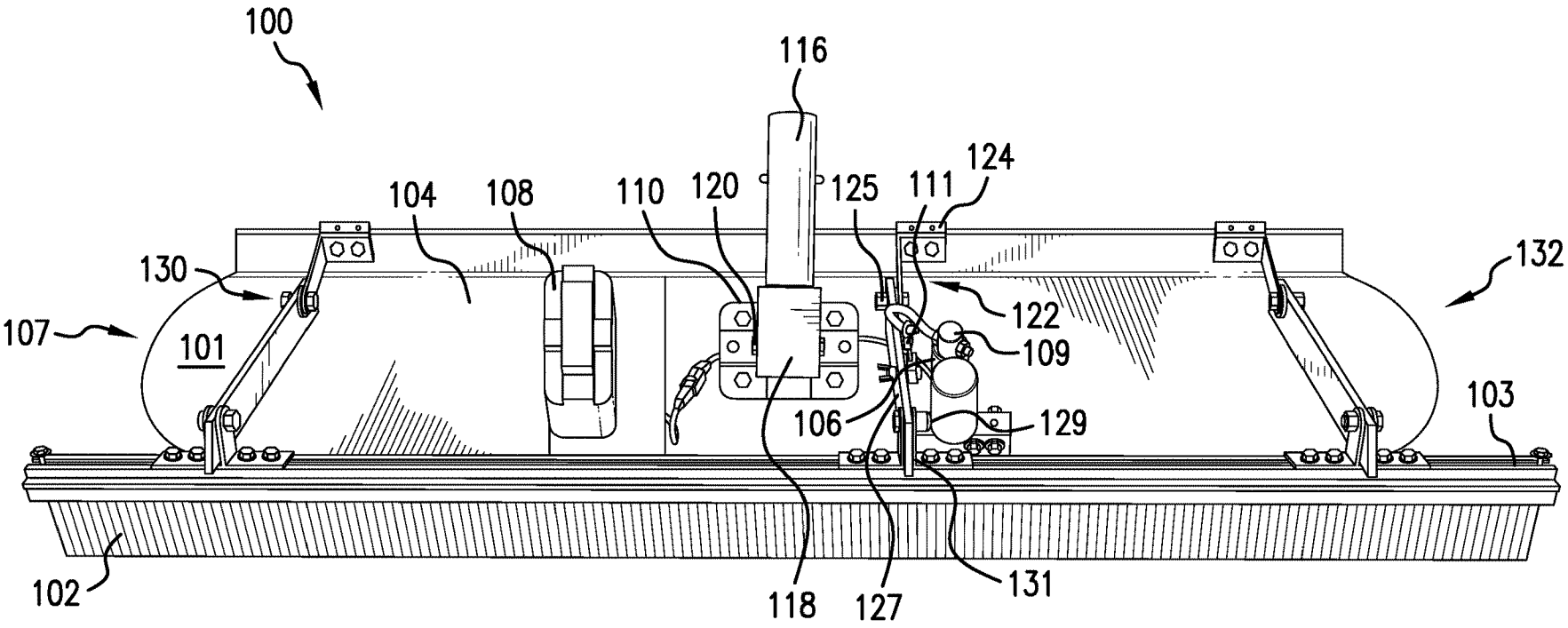
FIG. 2 is a top view of the substrate finishing tool with a motorized lift of FIG. 1 with implemented with a C-channel bull float trowel.

Referring to FIGS. 1-2, disclosed is a texturing tool 100 comprising of an interchangeable color-coded concrete texturing brush 102 that is mounted to a smoothing platform 104. Texturing tool 100 utilizes an actuator 106 powered by a battery 108 remotely activated with an electronic receiver 110 to lift and lower the texturing brush 102. This lifting and lowering of texturing brush 102 allows the operator to utilize smoothing platform 104 while also having the ability to engage texturing brush 102 to accomplish two tasks with a single texturing tool 100.

More specifically, smoothing platform 104 can have a top surface 101, a smoothing face 107 that is engaged with the substrate, and a leading edge 105 facing in a forward direction toward texturing brush 102. Smoothing platform 104 is illustrated as a c-channel bull float, but smoothing platform 104 can be any type of trowel, fresno trowel, float, bull float, or any other smoothing or texturing tool for a substrate, such as concrete.

A handle 116 is provided with one end for the operator and the other end connected to smoothing platform 104 by a coupler 118. Coupler 118 is combined to smoothing platform 104 by a horizontal pivot 120. This allows the operator to manually manipulate smoothing platform 104 by pushing and pulling the smoothing platform 104 across the substrate and raise and lower leading edge 105 of smoothing platform 104 so that leading edge 105 does not dig into the substrate.

Texturing brush 102 is combined to smoothing platform 104 by a first lifting frame 122. First lifting frame 122 can comprise a first bracket 124 combined to smoothing platform 104. If smoothing platform 104 has a vertical ridge, first bracket 124 can be combined to it. If smoothing platform 104 is flat, first bracket 124 can be mounted to top surface 101 of smoothing platform 104. A first pivot 125 is attached to first bracket 124. An elongated member 127 is combined to first bracket 124 by first pivot 125 so that it moves up and down with respect to first pivot 125. A second bracket 131 is combined to a brush frame 103 with a second pivot 129 attached to second bracket 131 and the other end of the elongated member 127. In order to have a more even lift of texturing brush 102 relative to smoothing platform 104, a second lifting frame 130 and a third lifting frame 132 can be provided on opposite sides of first lifting frame 122.

Actuator 106 is provided with a rod 109 that can be oriented vertically so that it is perpendicular to smoothing face 107 of smoothing platform 104. A slack line 111 is combined between rod 109 of actuator 106 and elongated member 127 of first lifting frame 122. When rod 109 extends vertically upward, slack line 111 pulls elongated member 127 upward to raise texturing brush off of the substrate. Slack line 111 is configured with slack when brush 102 is in the lowered position relative to smoothing platform 104 so that texturing brush 102 combined to brush frame 103 free floats on its own weight. This way when the operator is pushing and pulling smoothing platform 104 across the substrate and raising a lowering its leading edge 105, texturing brush 102 stays on the substrate.

Actuator 106 is powered by battery 108, which can be mounted to top surface 101 of smoothing platform 104. Actuator 106 can be activated via a remote control unit 140 comprising a switch 142 combined between a battery 144 and a transmitter 146. Transmitter 146 is in communication with receiver 110 on smoothing platform 104 and operatively connected to actuator 106 for remote operation of actuator 106 to move texturing brush 102 and brush frame 103 relative to smoothing platform 104 between the raised position and the lowered position. Battery 108 for actuator 106 can be mounted to top surface 101 of smoothing platform 104. Receiver 110 can be positioned between and electrically connected to battery 108 and operatively coupled to actuator 106. Transmitter 146 and receiver 110 can be configured to communicate via any wireless protocol including simple RF, Bluetooth, etc. Alternatively, switch 142 can be wired-remote controlled with an electrical connection between battery 108 and actuator 106 to simplify the circuit without using wireless remote control.

The operator can, by way of non-limiting example, begin by raising texturing brush 102 up so that the operator can complete any smoothing or texturing activity necessary. Then, once the operator desires to begin using texturing brush 102 to texture the substrate, the operator can simply press switch 142 to lower texturing brush 102 to apply a broomed texture to the substrate.

When texturing brush 102 is lowered it can sit in a "neutral" position, via built-in mechanical or natural stops, until the operator adjusts the pitch of smoothing platform 104. The pitch of smoothing platform 104 is manually manipulated by the operator with handle 116. The operator can also raise and lower texturing brush 102 off of the substrate. It is also possible that even though texturing brush 102 is in the lowered position and is in contact with the substrate, for it to maintain the ability to free pivot upward because of the slack in slack line 111. This reduces the chances of putting too much pressure on the substrate during broom texturing passes.

The motorized lift and lower action eliminates the need for the operator to utilize or install any sort of pin or hardware to hold the brush up and out of the way during the smoothing operation. This eliminates the need for the operator to retrieve such hardware when using the brush in conjunction for broom texturing.

It should be understood that the invention is not limited by the drawings herein. The actuator can move the brush frame relative to the trowel or the actuator can be connected to the handle or some other structure to move the brush relative to it. The actuator can be mechanical, hydraulic, pneumatic or electric. The lift mechanism can also be portable such that it can be easily and quickly removed from the trowel so that a different type of trowel can be installed.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A powered texturing tool comprising:

a smoothing platform;

a brush frame;

a brush combined to the brush frame; and an actuator attachable to the smoothing platform a rod combined to the actuator oriented perpendicular to a smoothing face of the smoothing platform to extend and retract upward with respect to the smoothing face;

an elongated member pivotally attached to the smoothing platform at one end and pivotally attached to the brush frame at the other end; and a slack line attached at one end to the rod and at the other end to the elongated member;

wherein the actuator is configured for moving the brush frame by way of the rod and the slack line relative to the smoothing platform between a raised position and a lowered position.

2. The powered texturing tool of claim 1, and further comprising a remote control switch combined to a transmitter in communication with a receiver combinable to the smoothing platform and operatively connected to the actuator for remote operation of the actuator to move the brush frame relative to the smoothing platform between the raised position and the lowered position.

3. The powered texturing tool of claim 2, wherein when the brush frame is in the lowered position there is slack in the slack line so that the brush and the brush frame free floats on its own weight.

4. The powered texturing tool of claim 1, and further comprising a first bracket combined to the smoothing platform; a first pivot attached to the first bracket; the elongated member combined to the first bracket by the first pivot; a second bracket combined to the brush frame; and a second pivot attached to the second bracket and the other end of the elongated member.

5. The powered texturing tool of claim 4, and further comprising a second lifting frame and a third lifting frame positioned on opposite sides of the first lifting frame.

6. The powered texturing tool of claim 5, and further comprising a coupler combined to the smoothing platform; a horizontal pivot; and a handle combined to the smoothing platform by the horizontal pivot so that the smoothing platform can be manually manipulated by an operator.

7. The powered texturing tool of claim 6, and further comprising a battery mounted to the smoothing platform, the receiver combined to the battery and operatively coupled to the actuator.

8. The powered texturing tool of claim 7, wherein the receiver is positioned beneath the coupler and between the battery and the actuator.

9. The powered texturing tool of claim 8, wherein the battery, the receiver, and the actuator are all mounted proximate to the coupler to position a center of mass of the platform proximate the coupler to enhance maneuverability of the smoothing platform.

10. The powered texturing tool of claim 4, wherein the slack line is attached to the elongated member between the first pivot and the second pivot.

* * * * *